United States Patent [19]

Martin

[11] 3,997,155

[45] Dec. 14, 1976

[54] SHEET HANDLING APPARATUS

[76] Inventor: Merrill D. Martin, No. 2 Mall Court, Oakland, Calif. 94611

[22] Filed: Apr. 13, 1976

[21] Appl. No.: 676,523

Related U.S. Application Data

[62] Division of Ser. No. 593,367, July 7, 1975.

[52] U.S. Cl. ..... 271/272; 271/184; 248/230

[51] Int. Cl.[2] ..... B65H 29/22

[58] Field of Search ..... 271/80, 81, 184, 198–203, 271/225, 272–274; 198/160, 167; 248/125, 429, 430

[56] References Cited

UNITED STATES PATENTS

| | | | |
|---|---|---|---|
| 1,962,789 | 6/1934 | Simpson et al. | 248/430 |
| 3,643,940 | 2/1972 | Lopez | 271/202 |
| 3,880,420 | 4/1975 | Martin | 271/202 X |

*Primary Examiner*—Robert W. Saifer
*Attorney, Agent, or Firm*—George B. White

[57] ABSTRACT

This invention pertains to the type of apparatus for handling sheets shown in U.S. Pat. No. 3,658,322 and particularly to the take-off conveyor on such apparatus on which the direction of the sheets issued from the sheet making machine is changed toward a stacker. The improvements pertain to the accurate adjustment of the back-up means on the take-off conveyor to correspond to the length of the sheets delivered from the sheet making machine thereby to allow accurate stacking of the bundles of sheets on the take-off conveyor; the adjustability is accomplished through a suitable selector dial on circuit control device which is calibrated for the length of the sheets and which when set to the particular length then through an electric circuit and driving mechanism moves the back-up abutments to that selected measurement accurately and automatically; another improvement is the adjustability of the snubber device at the discharge end of the take-off conveyor for adjustment to the thickness of the bundles of sheets; a further improvement includes adjustable snubbers on the layboy at the intake of the stacker device for adjustment to the width of the sheets for the proper transmittal of the sheets to the stacker conveyor.

4 Claims, 17 Drawing Figures

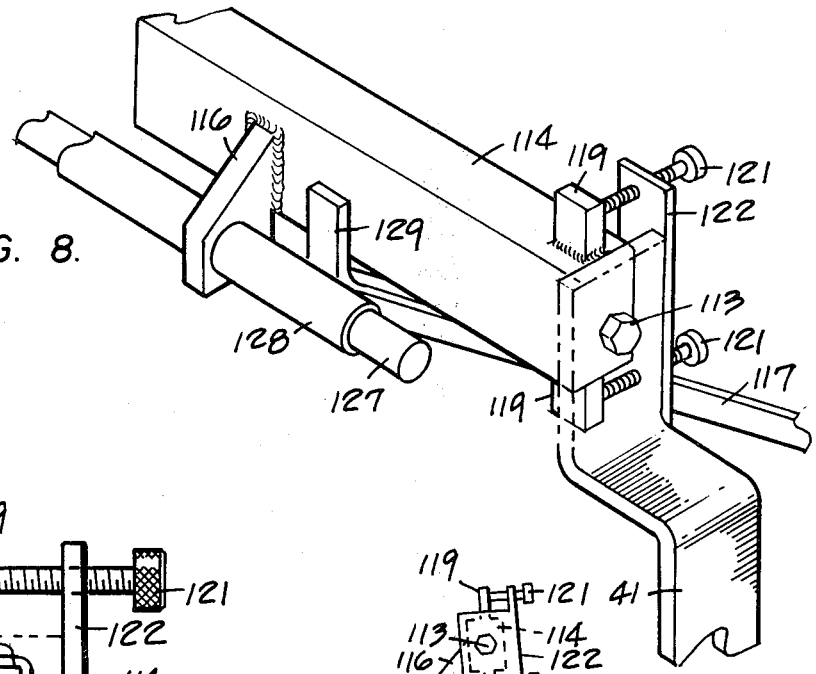
FIG. 8.
FIG. 9.
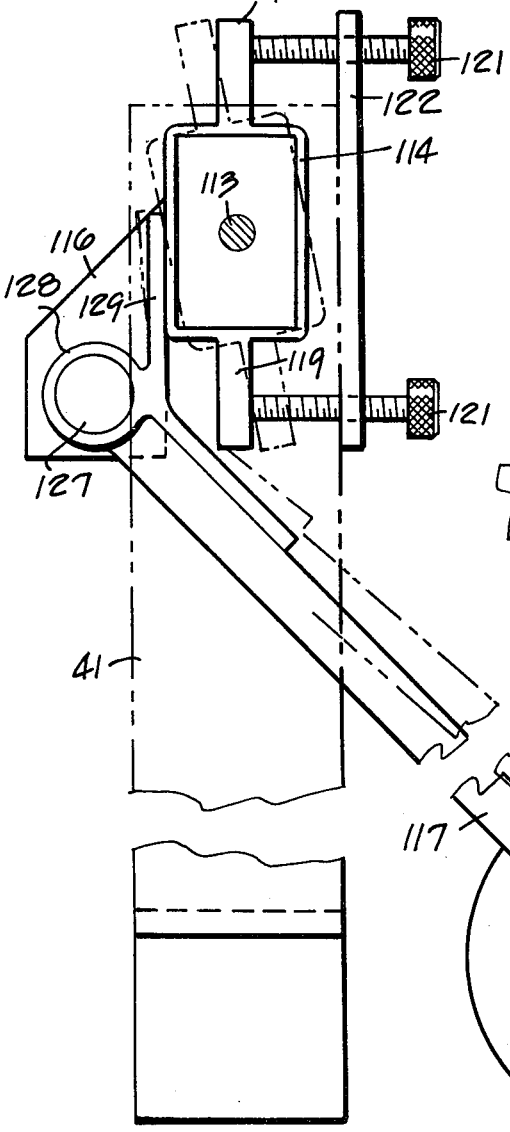
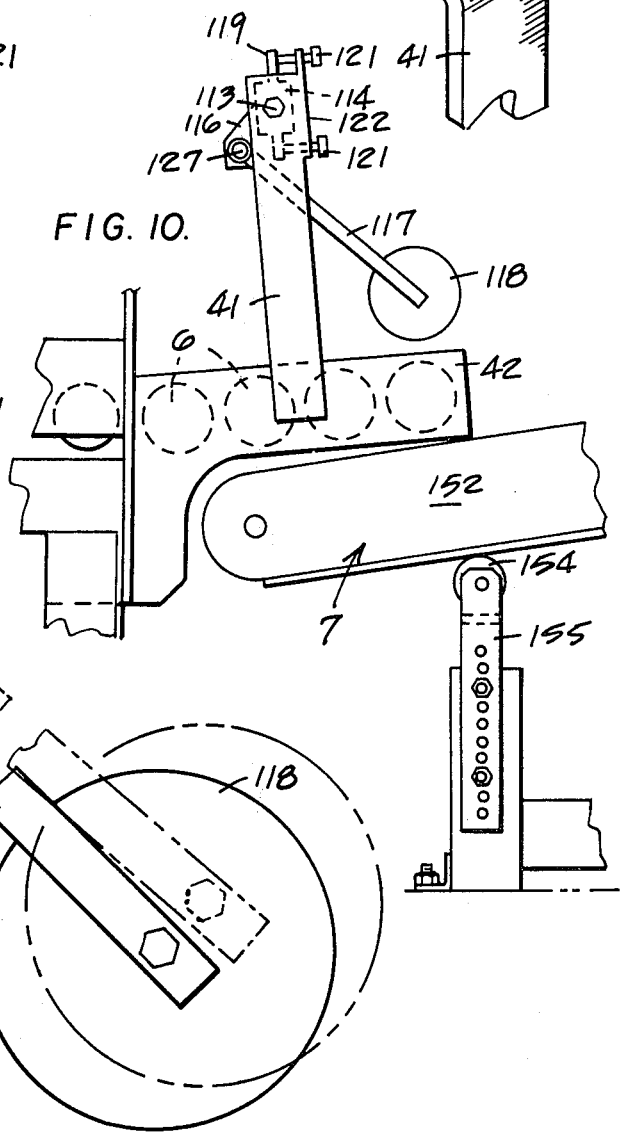
FIG. 10.

FIG. 15.
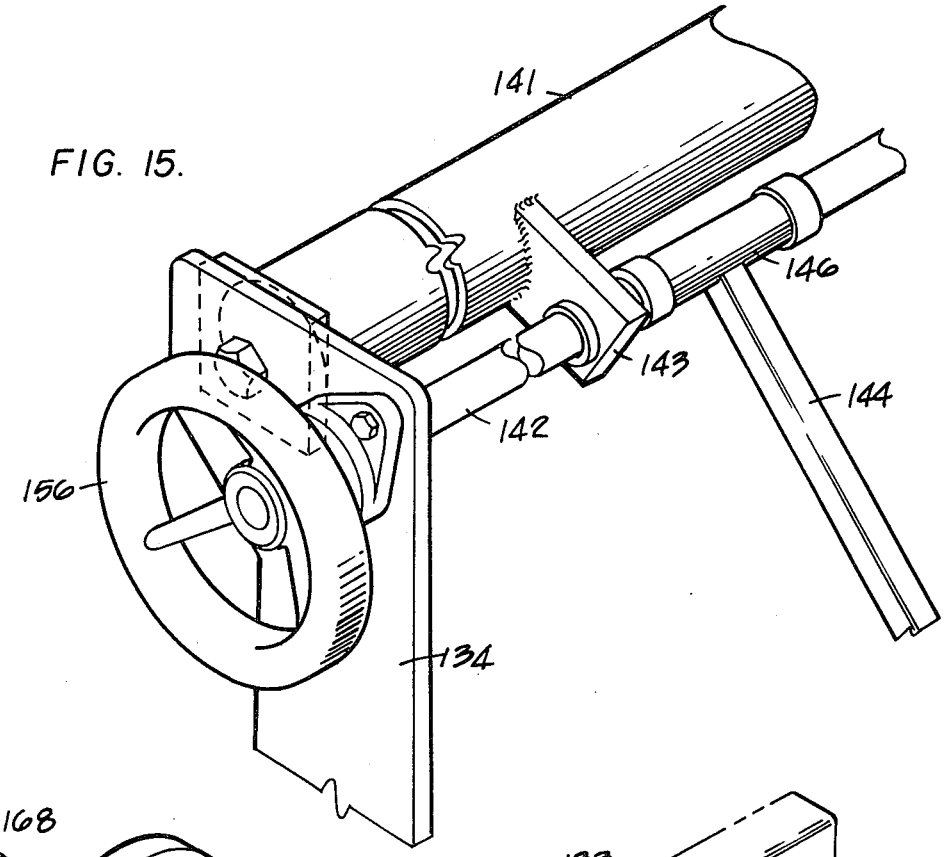
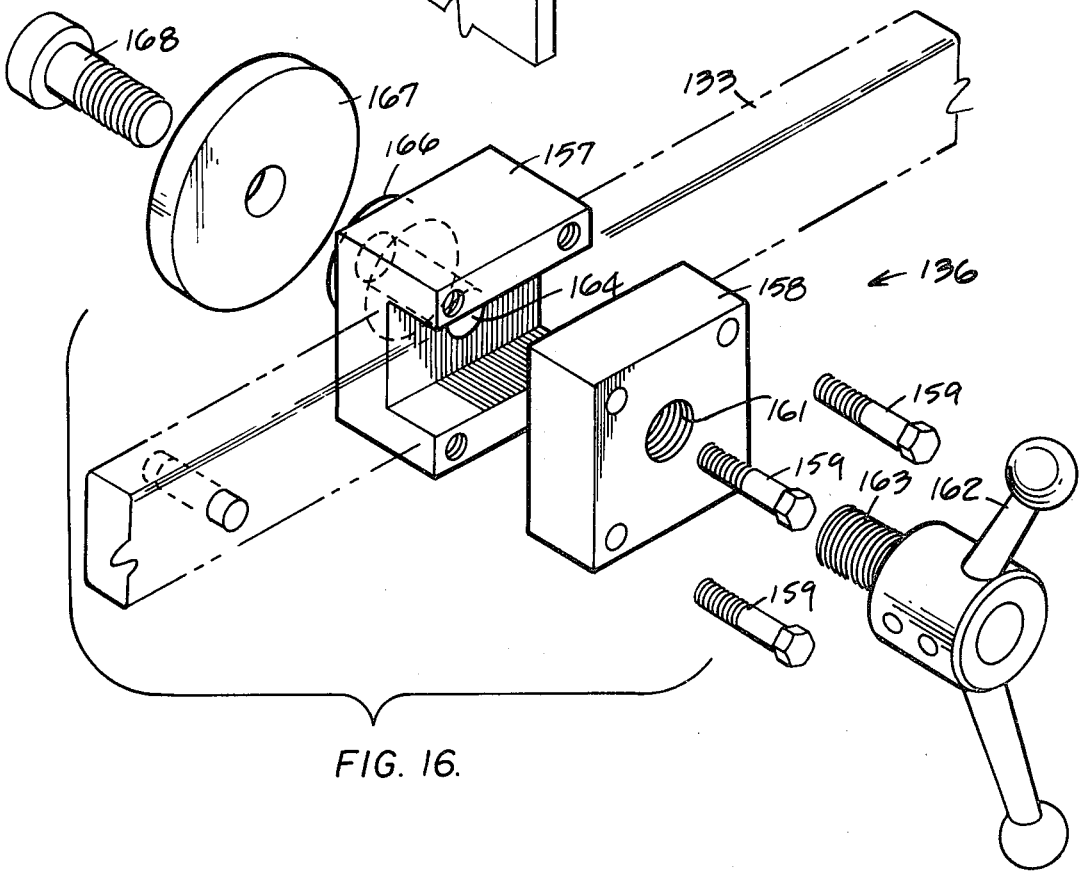
FIG. 16.

SHEET HANDLING APPARATUS

This is a division, of application Ser. No. 593,367 filed July 7, 1975.

BACKGROUND OF THE INVENTION

In previous devices the adjustments of the backstops to the length of the sheets discharged from the sheet making device were performed manually and the inaccuracy of such adjustments affected unfavorably the uniformity of the stacks formed at the discharge end of the stacker; furthermore the snubber mechanism must be properly adjusted both at the delivery end of the take-off conveyor and at the receiving end of the adjacent stacker device for proper transmittal of the bundles of sheets formed on the take-off conveyor.

The object of this invention is to provide accurate control for the positioning of the back-up device and also to facilitate the adjustment of the snubbers for the accurate arrangement and transmission of the bundles of sheets for stacking.

BRIEF DESCRIPTION OF THE DRAWINGS

FIG. 8 is a fragmental view showing the adjustable mounting for the snubbers at the discharge end of the conveyor.

FIG. 9 is a partly sectional view on a larger scale of the adjustable mounting ahd support of the snubbers.

FIG. 10 is the support in relation to the discharge end of the take-off conveyor above the layboy.

FIG. 15 is a fragmental perspective view showing part of the adjusting device for the snubbers at the layboy.

FIG. 16 is a developed view of the clamping device to clamp and hold the bracket of the snubber assembly in adjusted position.

DETAILED DESCRIPTION

Figure 1:
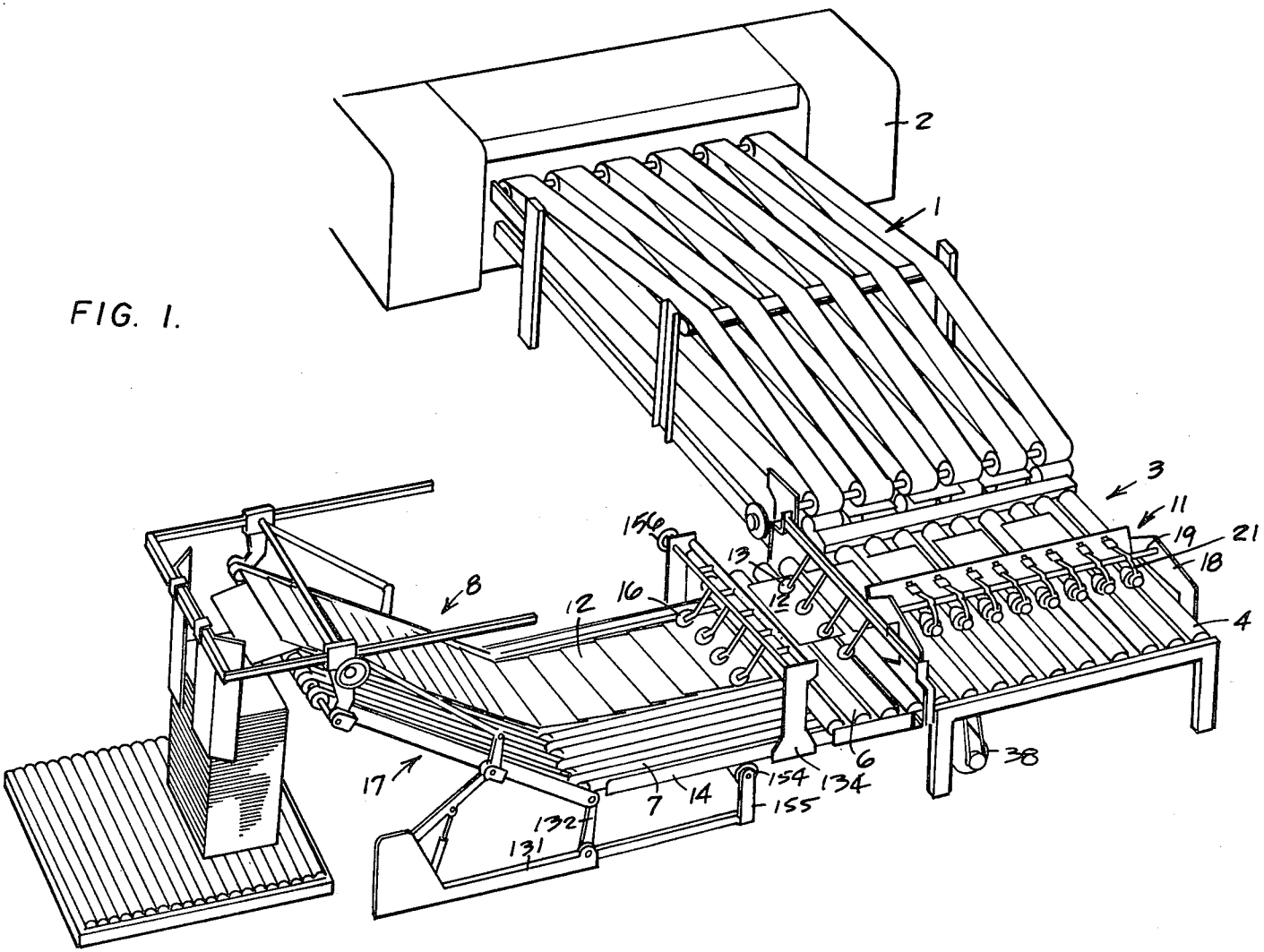
FIG. 1 is a perspective view of the conveyor system indicating the location of the improved devices thereon.

The overall conveyor system includes a delivery conveyor 1 which delivers the sheets from the sheet making machines such as a cutting machine 2. The sheets from the delivery conveyor 1 are dropped onto a take-off conveyor 3 which latter consists of a plurality of rollers 4 driven in the manner described in the aforementioned patent. Rollers 6 at the discharge end of the take-off conveyor are driven at an accelerated rate of speed whereby the sheets are delivered onto the layboy conveyors 7 of the stacker device 8 of the type described in Martin U.S. Pat. No. 3,321,202. The ratio of speed of the various conveyors, as described in the first mentioned patent, is such that the sheets are advanced on the take-off conveyor a distance equal to the width of one sheet at the rate of the cutting of the sheets by the cutting machine 2 whereby the rows of sheets passing upon the take-off conveyor 3 ultimately are stacked in bundles equivalent to the number of multiple cuts by the cutting machine 2.

For the proper alignment of the sheets on the take-off conveyor 3 the sheets delivered thereon are aligned by a back-up device 11. The bundles of sheets 12 are suitably held together on the accelerated speed rollers 6 by a row of snubbers 13. The bundles are then transferred to the intake end of the layboy conveyors 7 and then to a stacker device 8. In the present illustration the layboy conveyors 7 are on a rocking layboy frame 14 and are held together in bundles by snubbers 16. The pivoted portion 17 of the stacker device 8 rises and lowers and operates in the manner described in said Martin U.S. Pat. No. 3,321,202.

Figure 2:
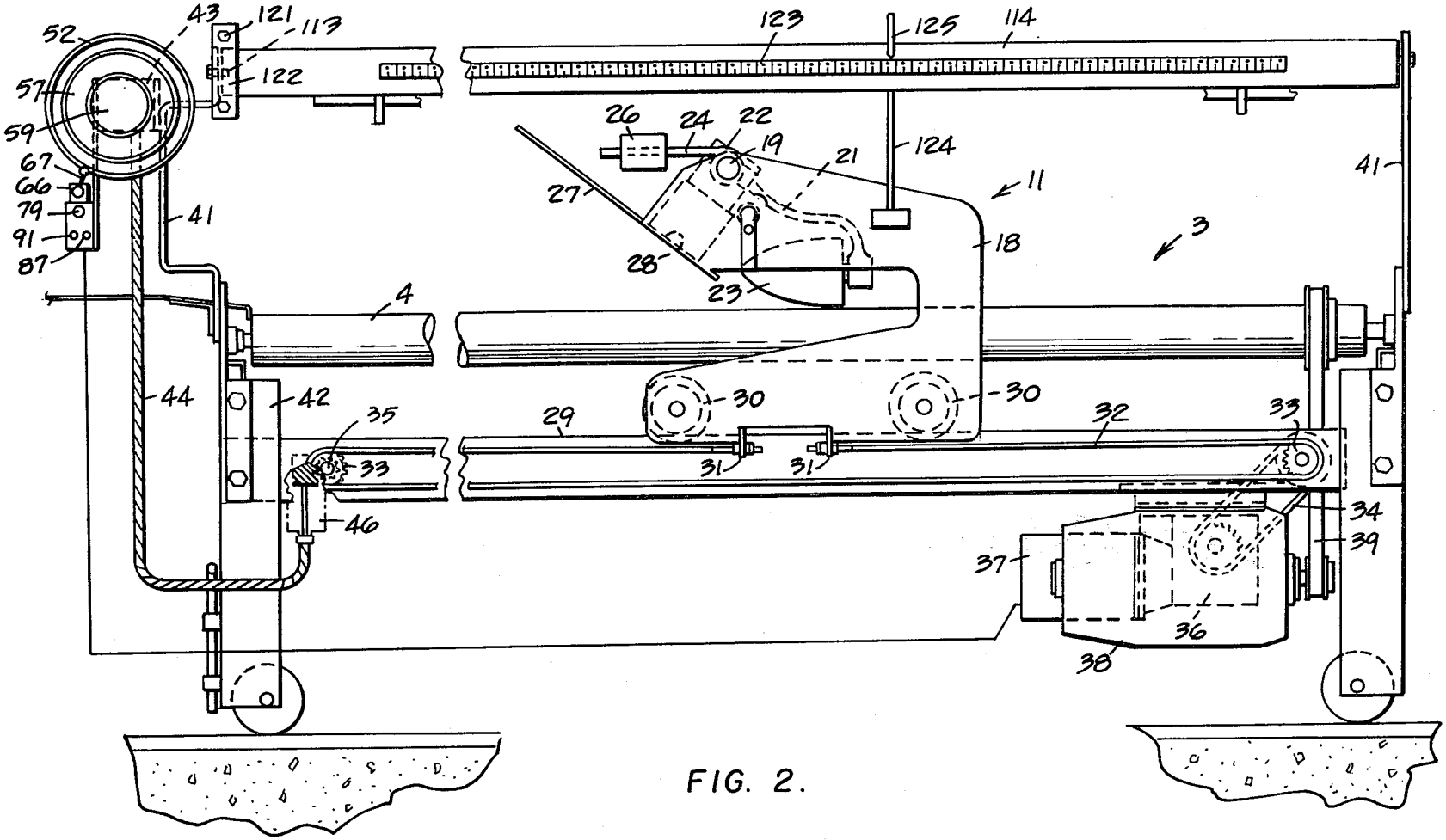
FIG. 2 is an end view of the take-off conveyor showing one end of the support for the back-up device and its connection for the adjustment of the spacing of the back-up abutments.
Figure 6:
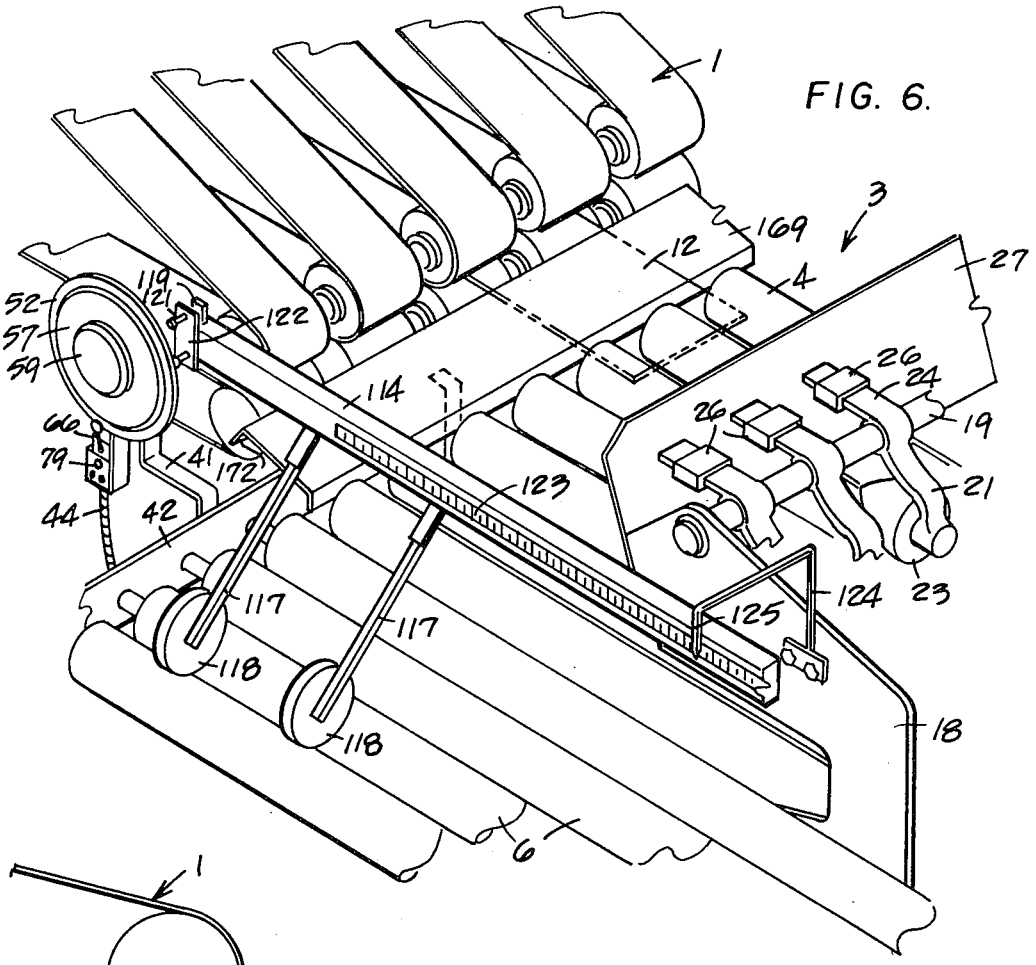
FIG. 6 is a fragmental perspective view showing the relation of the indicator for the back-up support to the snubber support at the discharge end of the take-off conveyor.
Figure 7:
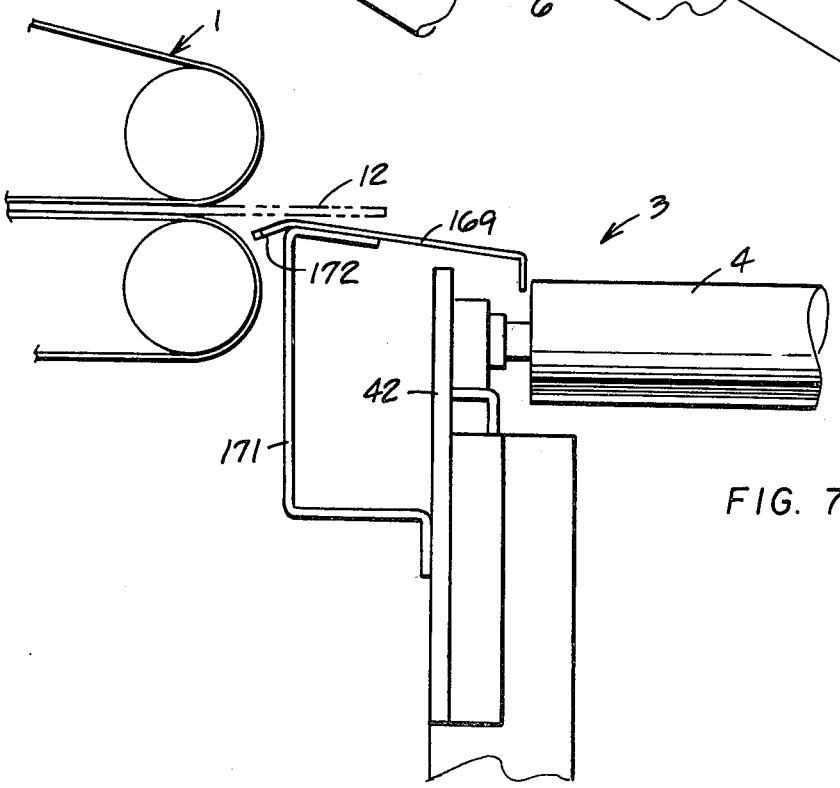
FIG. 7 is a fragmental view showing the guard and guide for the sheets at the delivery to the take-off conveyor.

The back-up device 11 includes a bracket 18 at each end of the take-off conveyor 3. A shaft 19 is extended between the brackets. On the shaft 19 are a plurality of levers 21, as shown in FIGS. 2 and 6. Each lever 21 has a hub 22 rotatable on the shaft 19. On the lower end of each lever 21 is an abutment member 23 which tapers parallel with the adjacent rollers 4 toward the receiving side of said take-off conveyor 3. An arm 24 extends from each hub 22 and on each arm 24 there is a counter-weight 26 slidable on the respective arm 24 for the selected balance or play required to accommodate the sheets in the respective bundles travelling along the take-off conveyor 3. A deflector plate 27 is secured to slanting edges 28 of the brackets 18 facing toward the receiving side of the take-off conveyor 3 and diverging from the rollers 4 upwardly and toward the receiving side of the take-off conveyor 3 thereby to deflect the sheets thrown off the delivery conveyor 1 downwardly below the tapered abutment members 23, thereby to accurately register and align the edges of the sheets as they are bundled and travel on the take-off conveyor 3.

In order to accurately adjust the positions of the abutment members 23 to the length of the sheets 12 delivered onto the take-off conveyor 3, the back-up device 11 is adjustable. Each bracket 18 has a pair of wheels 30 thereon which ride on an adjacent rail 29 as shown in FIG. 2. From the bottom edge of each bracket 18 extend a pair of ears 31 and on each ear is anchored the end of a chain 32. Each chain 32 is on a suitable sprocket 33 at each end thereof, which latter are journalled near the respective ends of the rail 29. One of the sprockets 33 is driven by a chain and sprocket drive 34. A suitable reduction gearing 36 driven by an electric motor 37 drives the chain and sprocket drive 34 in selected directions. The sprockets 33 farthest from the chain and sprocket drive 34 are keyed on a cross shaft 35 for simultaneously adjusting the position of the brackets 18 to the length of the sheets 12 delivered to the take-off conveyor 3. Another electric motor 38 or other suitable power source drives through a belt and pulley transmission 39 the rollers 6 in the manner described in said first mentioned Martin Patent.

Figures 3, 4:
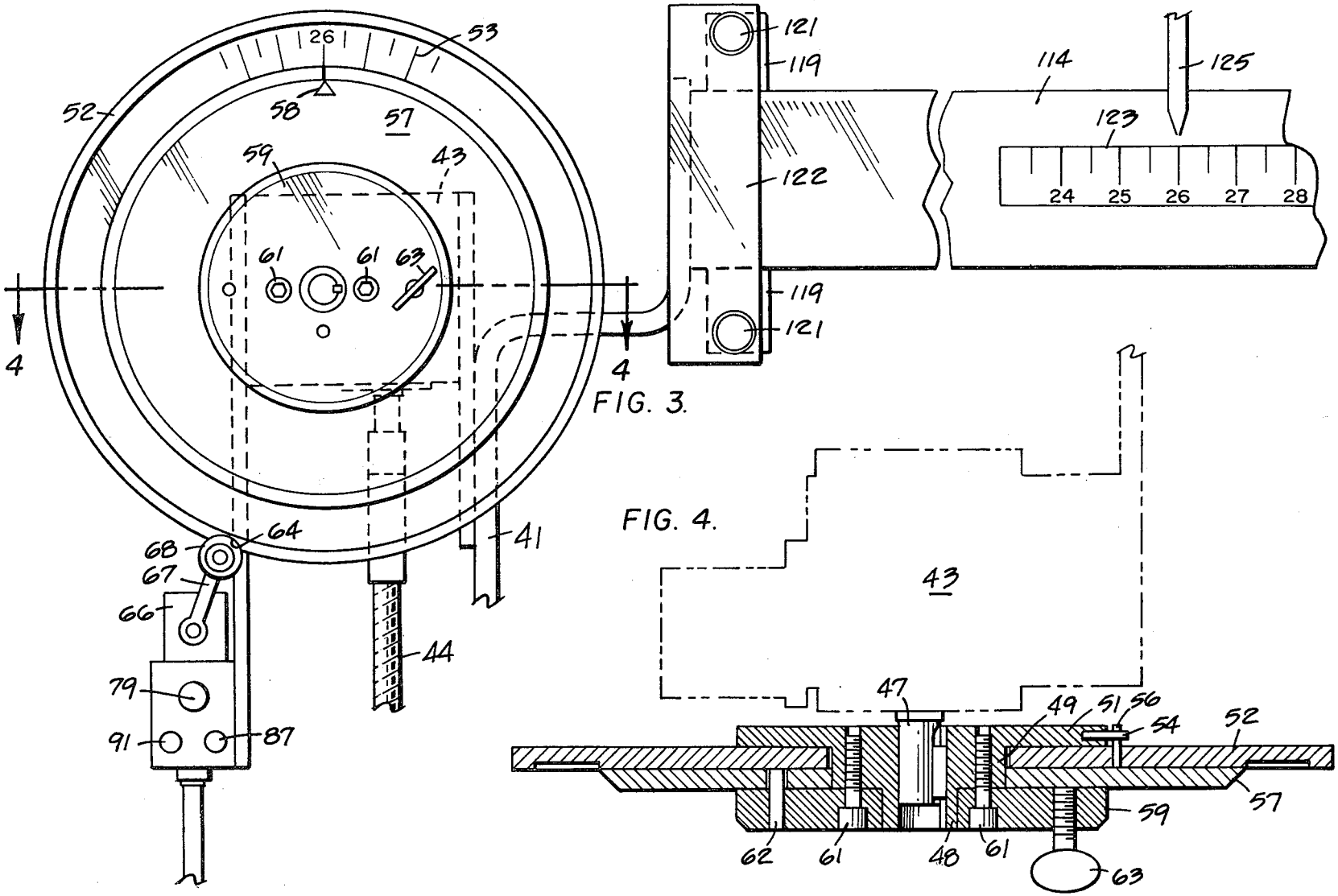
FIG. 3 is a fragmental end view of the dial and switch control and indicator for the back-up adjustment on a larger scale.
FIG. 4 is a sectional view of the adjustment control device, the section being taken substantially on 4—4 of FIG. 3.

The controls for the adjustment of the back-up device 11 are illustrated in FIGS. 2, 3, 4, 5, and 6. On a fixed bracket 41 on one side of frame member 42 of the take-off conveyor 3 is mounted a suitable reduction gearing 43 which is connected by a flexible cable 44 to a gear transmission 46 on the cross shaft 35. A drive shaft 47 extends from the reduction gearing 43 and is keyed to a bearing hub 48. This bearing hub 48 is formed with an enlarged boss 49 and a disc 51. On the enlarged bearing boss 49 is rotatable a dial disc 52 with scale graduations 53 thereon. From the disc 51 extends a radial pin 54. Limit pins 56 extend from the dial disc 52 and are so spaced so as to limit the rotating motion of the dial disc 52 within the range of the graduations 53. On the boss 49 is a pointer disc 57 with a pointer mark 58 on its edge. A clamping disc 59 is fixedly secured to the boss 49 by screws 61. The pointer disc 57 is connected to the clamping disc 59 by a pin 62 extending from the clamping disc 59 into the pointer disc 57 as shown in FIG. 4. A screw 63 is threaded through the clamping disc 59 and bears against the pointer disc 57 so as to press the same tightly against the dial disc 52 and thereby to rotate the dial disc 52 with the pointer disc 57. By loosening the thumb screw 63 the dial disc 52 is freed for independent rotary adjustment.

Figure 5:
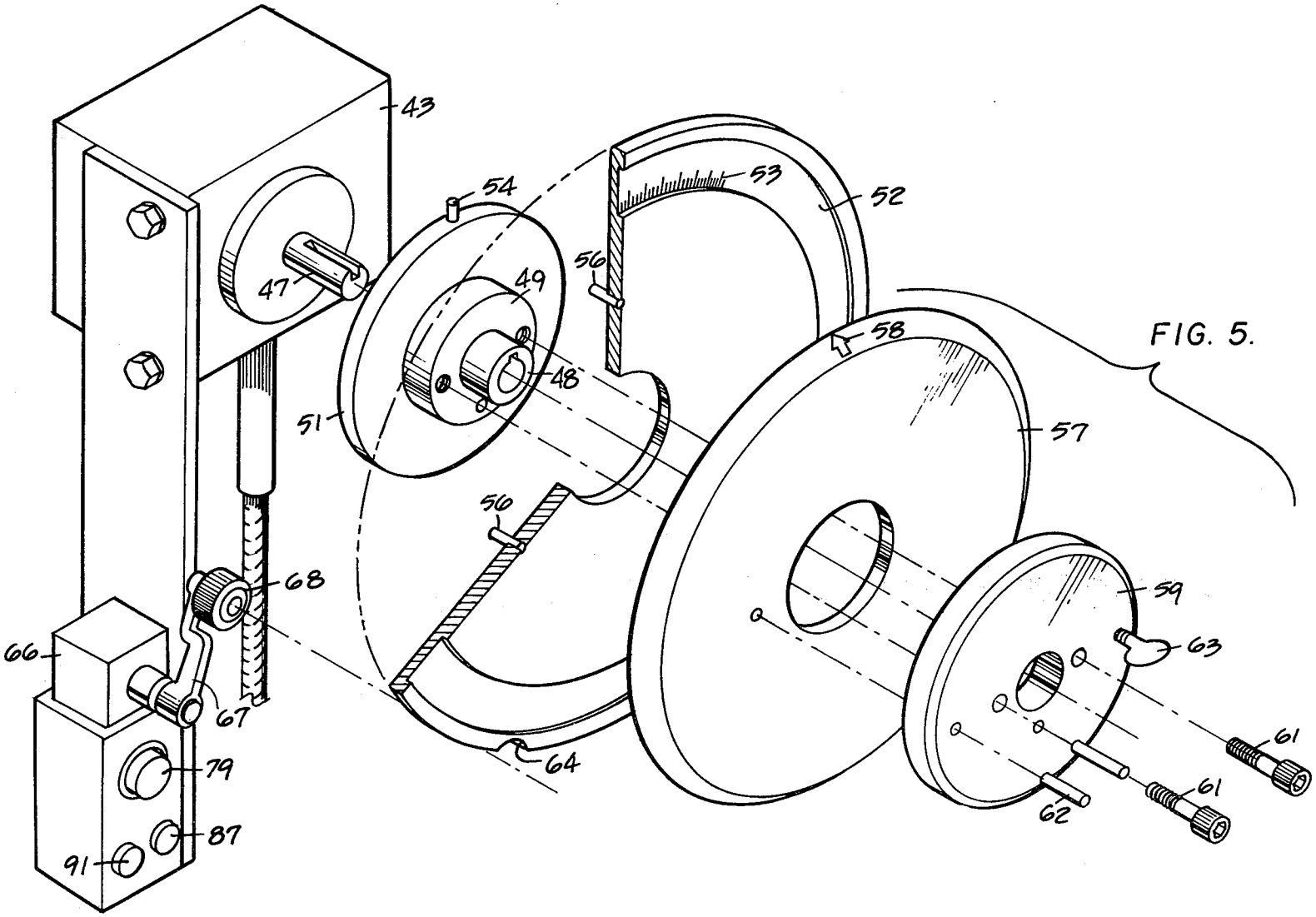
FIG. 5 is a developed view of the adjustment control device and the switch actuated by the dial and reductor transmission.

The dial disc 52 has a recess 64 in its periphery. A two-circuit spring return switch 66 has an arm 67 with a roller 68 on its end in engagement with the recess 64, in the initial position of the dial disc 52, as shown in FIG. 5 The graduations 53 on the dial disc 52 are on a scale proportionate to the sheet lengths and correspond to the ratio of the reduction gearing 43 to the rate of rotation of the sprocket shaft 35 and corresponding to the unit of movement of the back-up device 11. When the dial disc 52 is loosened it is turned to the graduation indicating the selected length of sheet, and the roller 68 is pushed out of the recess 64 into circuit closing position of the switch 66. Then the pointer disc 57 is tightly clamped against the dial disc 52 so that its pointer mark 58 points to the graduation of the selected sheet length. The adjusting motion of the back-up device 11 is converted by the gear transmission 46, the flexible cable 44 and the reduction gearing 43 into rotation of the dial disc 52 of the control unit proportionate to the adjusting movement of the back-up device 11, so that when the back-up device 11 reaches the selected spaced position, the dial disc 52 is returned to its initial position and the switch roller 68 is again nesting in the recess 64 thereby opening the two-circuit switch 66. The pointer mark 58 remains pointing to the graduation indicating the sheet length to which the back-up device is adjusted.

Figure 17:
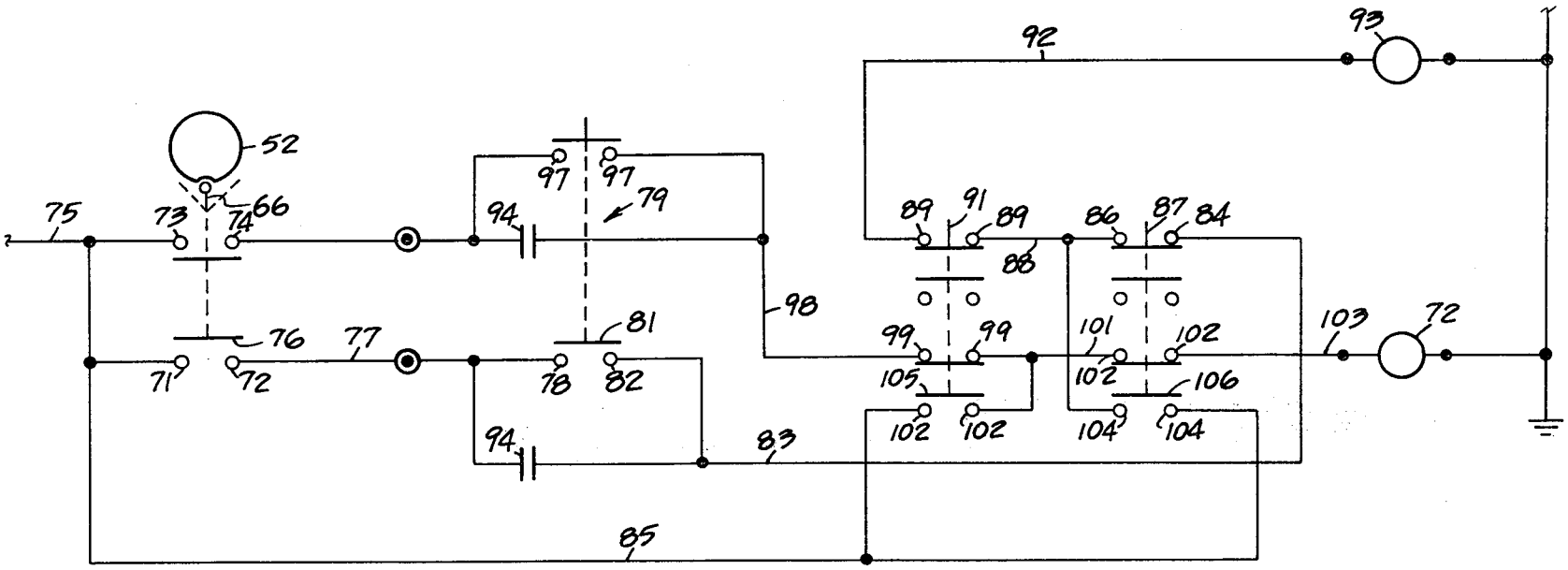
FIG. 17 is a diagram of the circuits for adjusting the back-up device.

The electrical circuit for controlling the adjustment of the back-up device is illustrated in FIG. 17. Terminals 71, 72, 73 and 74 in the switch 66 are for the circuits for adjustments in opposite directions. Terminals 71 and 72 are for operating the electric motor in a direction to move the back-up device away from the delivery conveyor 1 thereby to provide for longer sheets and this circuit is herein referred to as for "longer" adjustment. The terminals 73 and 74 are connected in a circuit for rotating the motor 37 in the opposite direction, thereby to move the back-up device closer to the delivery conveyor 1 to adjust for shorter sheets and this second circuit is herein referred to as for the "shorter" adjustment.

The terminals 71 and 73 are both connected to a line 75. For the longer adjustment, the switch 66 is shifted by rotating the dial disc 52 in the direction to connect the bridge 76 for closing the circuit through terminals 71 and 72 into the longer adjustment circuit. Thus line 75 then is connected to line 77 which is connected to one of the terminals 78 of a spring return switch 79 which latter initiates the operation of the motor by its bridge 81 bridging terminals 78 and 82 to line 83. For purposes hereinafter described, line 83 passes through terminals 84 and 86 of a spring return button switch hereinafter called "jog longer" button switch 87 and then to line 88 through the terminals 89 of a "jog shorter" spring return button switch for purposes to be hereinafter described, and then to a line 92 to the electromagnet of an electromagnetic switch 93, thereby to energize the electromagnetic switch 93 and close the circuit of the electric motor 37 to rotate in a direction to move the back-up device away from the delivery conveyor 1 for longer sheets.

The button switch 79 operates momentarily and is spring-returned into open position so that when the button switch 79 is closed and the circuit is closed from line 77 to line 83, it energizes an auxiliary electromagnetic switch 94 which keeps the circuit between line 77 and line 83 closed as long as the switch 66 is in circuit closing position. Whenever the switch 66 is spring returned to the opening position then the auxiliary electromagnetic switch 94 is de-energized.

When the dial disc 52 is turned in the direction opposite to the previous turning then the terminals 73 and 74 are bridged by the switch 66 and connect the supply line 75 with line 96, and through the terminals 97 of the spring return button switch 79 when the latter is closed, and then through line 98 and through terminals 99 of the normally closed jog shorter button switch 91 and line 101 and terminals 102 of the normally closed jog longer button swith 87 to line 103 and to the electromagnet of the shorter switch 72 to operate the motor 37 in the opposite direction thereby to shorten the distance between the back-up device and the delivery conveyor 1. When the button switch 79 closes the bridge 81, it energizes the auxiliary electromagnetic switch 94 which remains energized as long as the switch 66 keeps the line closed between terminals 73 and 74.

The jog shorter and jog longer button switches 91 and 87 are normally in circuit closing position. For the purpose of more minute adjustments in either direction terminals 102 can be bridged by a bridge 105 by pressing the jog shorter button switch 91 whereupon the current is closed from line 85 to line 101 and terminals 102 to line 103 to the shorter electromagnetic switch 72. By pressing the jog longer button switch 87 its bridge 106 closes the circuit between terminals 104 between the supply line 75 to terminals 104 to line 88 and through terminals 89 to line 92 and to the longer electromagnetic switch 93 so as to operate the motor 37 in the opposite direction. Thus, even when the switch 66 is in the neutral position accurate adjustments can be made either to shorten or to lengthen the distance between the back-up device and the delivery conveyor 1.

The snubber assembly 13 is near the delivery end of the take-off conveyor 3 and as shown in FIGS. 6, 8, 9, and 10 it is supported on brackets 41 which are secured to the opposite side frames 42 adjacent the accelerating rollers 6. A cross-shaft 113 extends between the brackets 41 above the adjacent rollers 6. A tubular cross-bar 114 of rectangular cross section has its solid ends journalled on the shaft 113. On the cross bar 114 are spaced lugs 116 from which lugs extend snubber arms 117. On the free or lower end of each snubber arm 117 is a snubber roller 118. The cross-bar 114 has at each end thereof a perpendicular ear 119 extending both from its top and bottom thereof. Set screws 121 are threaded into plates 122 on one of the brackets 41 and bear against the adjacent ears 119 respectively. By adjusting the screws 121 as illustrated in full and in dotted lines in FIG. 9 the position of the cross bar 114 can be tilted to selected angles thereby to raise or lower the snubber rollers 118 according to the thickness of the bundle on the take-off conveyor rollers 6. In this manner the bundles are held together in spite of the accelerated movement on the rollers 6. The face of the cross-bar 114 facing toward the delivery end of the take-off conveyor 3 is provided with sheet length graduations 123 as shown in FIG. 2. A finger 124 extended from the back-up device bracket 18 adjacent said accelerated roller 6 has a pointer 125 thereon adjacent the graduations 123 to indicate the measurement to which the back-up device is adjusted.

The manner in which the snubber arms 117 are supported on the lugs 116 is illustrated in FIGS. 8 and 9. A shaft 127 is extended through the lugs 116 and a sleeve 128 is rotatable on the shaft 127 and each arm 117 is connected to one of the sleeves 128. Each sleeve 128 has a flange 129 extended upwardly and around the adjacent face of the cross bar 114 so as to limit the downward movement of the arm 117 and the snubber roller 118. Upward movement of the roller 118 and the arm 117 is permitted when the thickness of the bundle passing so requires but the weight of the roller 118 is such that it will hold the sheets bundled together.

The second snubber device 16 is above the intake end of the layboy 7 as shown in FIG. 1. The function of this second snubber device 16 is to hold the sheets in the bundle and prevent their irregular spreading while the layboy 7 is rocked to follow the rising or lowering stacker device 8.

Figures 11, 12, 13, 14:
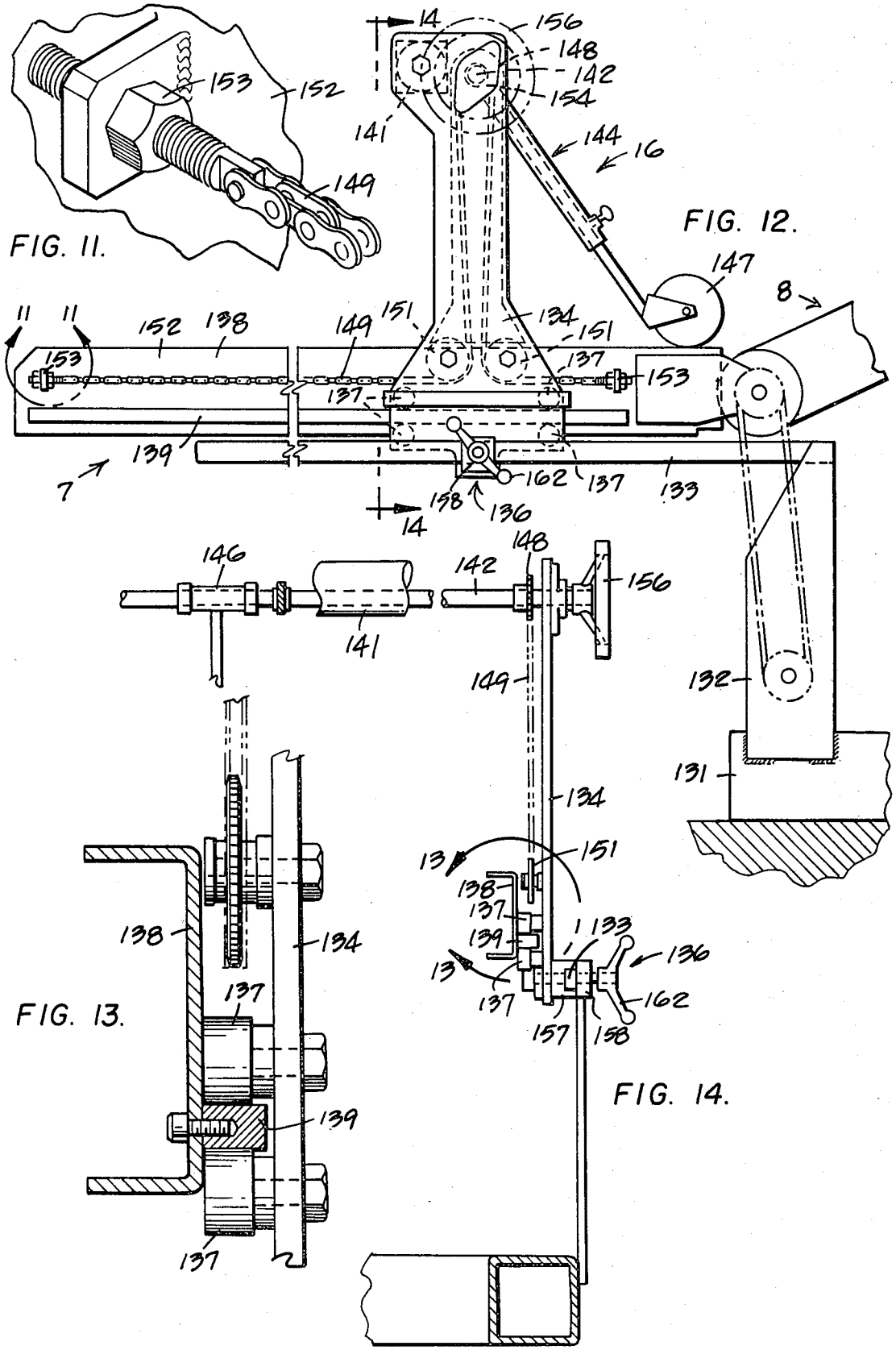
FIG. 11 is a fragmental perspective view of the anchoring of the adjusting chain for the snubber support at the receiving end of the layboy.
FIG. 12 is a side view of the adjustable assembly for the snubber rollers at the receiving end of the layboy.
FIG. 13 is a partially sectional view of the guiding of the supporting bracket of the snubber assembly at the layboy.
FIG. 14 is a partially sectional view of the adjusting and clamping device for one of the brackets of the snubber assembly at the layboy.

From the stacker device base 131 extend brackets 132 from each of which extends a horizontal bar 133. Each snubber bracket 134 has a clamping device 136 whereby the bracket 134 is held stationary on the bar 133 in adjusted positions. On the inside face of each snubber bracket 134 are mounted a pair of spaced rollers 137. The side frame 138 of the layboy 7 has a guide bar 139 thereon travelling between the rollers 137 as shown in FIGS. 13 and 14. A cross-bar 141 connects the opposite snubber brackets 134 at the upper ends thereof. Adjacent the cross-bar 141 and parallel therewith is an adjusting shaft 142 which is journaled in lugs 143 extended from the cross-bar 141. The snubber arms 144 have a sleeve 146 rotatable on the shaft 142. Each snubber arm 144 has a snubber roller 147 suitably journaled at its free end for engagement with the bundles of paper passing onto the layboy conveyors 14. Adjacent each end of the adjusting shaft 142 at the adjacent snubber bracket 134 is an adjusting sprocket 148. Around each sprocket 148 is an adjusting chain 149 which chain passes over a pair of spaced sprockets 151 in opposite directions as shown in broken lines in FIG. 12. Along each adjacent face of the adjacent side frame 152 of the layboy 7 are spaced anchors 153 spaced oppositely from the respective adjacent bracket 134. The ends of the adjusting chain 149 are anchored on the respective anchors 153. As shown in FIGS. 1 and 10 the side frame 152 of the layboy 7 rides on rollers 154 on brackets 154 supported on the base of the stacker base frame. As the layboy 7 reciprocates the chain 149 idles around and with the top sprocket 148 and with the lower guide sprockets 151. The upper sprockets 148 are pinned or keyed on a cross shaft 142 which is journalled in the opposite brackets 134. On one end of the cross shaft 142 is a head 154 and on the other end of the cross-shaft 142 outside of the adjacent bracket 134 is a handle wheel 156. The position of the snubber brackets 134 is adjusted by turning the handle wheel 156 in the desired direction and then, through the chain 149 and sprockets 148 and 151, the snubber brackets 134 travel on the guide bars 139 to locate the snubber 147 in the desired position.

Each bracket 134 is tightly clamped on the bar 133 in the adjusted position by clamping means 136. The clamping means are illustrated in detail in FIG. 16. In the clamping means a U-shaped block 157 has its cavity slidably fitting on the horizontal bar 133. A cover block 158 is screwed on the legs of the U-shaped block 157 by screws 159. The cover block 158 has a threaded hole 161 therethrough. A handle 162 is provided with a set screw 163 which fits into the hole 161 so that when the set screw 163 is tightened it bears against the bar 133 and fastens the U-shaped block 157 on the bar 133. The bracket 134 has a hole therethrough fitting over a boss 166 on the back of the U-shaped block 157. A clamping washer 167 is pressed against the bracket 134 by a set screw 168 extended through the washer 167 and through the boss 166 and threaded into the hole 164 so as to tightly fasten the assembly together. In order to adjust the position of the snubber assembly 16 the clamps on both sides are loosened and the handle wheel 156 is turned which through the shaft 142 also rotates the sprocket 148 on the other side of the machine so that both chains 149 travel in unison and advance both brackets 134 in alignment whereupon the handle 162 is tightened to hold the brackets 134 in adjusted position. As shown in FIG. 1 the conveyors 14 of the layboy 7 are located in part under the accelerating rollers 6 so that the accelerating rollers 6 throw the bundles of sheets on the conveyors 14 of the layboy 7. It is important that the snubber rollers 147 engage the sheets at about the leading edges thereof. As shown in FIG. 1 the adjustment is for the narrowest board, and as illustrated in FIG. 12 the snubbers 16 are adjusted to the widest possible board or sheet.

A guard 169 is supported on brackets 171 on the side frame of the takeoff conveyor in registry with the lower of the sandwich conveyors 1. The guard 169 is inclined downwardly over the rollers 4 of the take-off conveyor 3 so as to guide the sheet toward the back-up device 11. A scraper flange 172 along the edge of the guard 169 adjacent the delivery conveyor 1 extends downwardly to scrape off material that may adhere to the adjacent lower conveyor.

I claim:

1. An adjustable snubber device for a conveyor having movable frame members, and stationary supports, a fixed element on said supports along each side of said movable conveyor frame, a perpendicular bracke clamped on each support extending upwardly to above the level of said conveyor, a cross-member connecting the brackets spaced above said conveyor, a plurality of snubber arms extended downwardly from said cross member, snubber rollers on the lower free ends of said arms, sprocket means on each bracket spaced above said fixed element, idler sprockets on each bracket adjacent said movable conveyor frame, and a chain on said sprocket means extended around said idler sprockets in opposite directions, and having its ends anchored on the adjacent movable frame member whereby said chain idles around said sprocket means and said idler sprockets during movement of said conveyor, releasable clamping means to clamp each bracket on the adjacent fixed element and means to rotate the sprocket means of said brackets simultaneously, when said clamping means are released, thereby to shift the position of said brackets on said support relatively to said frame members, and to locate said snubber rollers in adjusted position relatively to sheets conveyed on said conveyor.

2. The adjustable snubber device specified in claim 1, and said rotating means including a connecting shaft between the sprocket means of the opposite brackets to transmit rotation from one sprocket means to the other, and handle means on said one sprocket means for turning the same.

3. The adjustable snubber device specified in claim 1, and said clamping means including a block element related to each bracket being slidable on said fixed element, and a releasable clamping member on the block element engageable with said fixed element to hold the block element against sliding.

4. The adjustable snubber device specified in claim 1, and a guide element on each conveyor framemember, and coacting guide means on each adjacent bracket guiding said guide element during the movement of said conveyor relatively to said brackets.

* * * * *